United States Patent [19]

Strickland

[11] Patent Number: 4,462,465

[45] Date of Patent: Jul. 31, 1984

[54] CONTROLLING INJECTION OF FLUIDS INTO WELLS

[75] Inventor: Cynthia E. Strickland, Dallas, Tex.

[73] Assignee: Otis Engineering Corporation, Dallas, Tex.

[21] Appl. No.: 393,064

[22] Filed: Jun. 28, 1982

[51] Int. Cl.[3] ..... E21B 23/03

[52] U.S. Cl. ..... 166/117.5; 166/318; 166/332

[58] Field of Search ..... 166/117.5, 318, 332–334

[56] References Cited

U.S. PATENT DOCUMENTS 4,066,128 1/1978 Davis et al. ..... 166/117.5

4,407,362 10/1983 Bechthold ..... 166/117.5

*Primary Examiner*—Ernest R. Purser

*Attorney, Agent, or Firm*—H. Mathews Garland

[57] ABSTRACT

A side pocket mandrel has an elongated receptacle in the side pocket, parallel with the main bore. A lateral side port communicates the receptacle with the exterior of the side pocket of the mandrel. A flow control assembly includes a sliding sleeve valve and a control valve, both designed to be removable from the receptacle. The sleeve valve is movable within the receptacle between a closed position and an open position relative to the side port, and includes collet fingers having outwardly projecting latching lugs for engagement in a receptacle latching recess in the closed position. The bore of the receptacle is slightly larger below the latching recess than it is above the recess, so that limited inward movement of the latching lugs, restrained by an insert within the sleeve valve, will permit movement of the valve downward to the open position but will not allow movement of the valve upward from the closed position, so long as the insert is in place. A control valve, to be selectively placed within the receptacle and latched with the sleeve valve includes a nose which is received within the sleeve valve and limits the inward deflection of the collet finger latching lugs. The control valve includes a latching lug for latching in another receptacle latching recess, when the sleeve valve has been moved to the lower open position. The control valve and sleeve valve have a coacting latching mechanism so that when the control valve is withdrawn, it lifts the sleeve valve to the closed position and then disengages from the sleeve valve. The sleeve valve includes an internal latching recess to enable withdrawal of the sleeve valve from the receptacle by a suitable pulling tool.

17 Claims, 12 Drawing Figures

CONTROLLING INJECTION OF FLUIDS INTO WELLS

BACKGROUND OF THE INVENTION

This invention relates to apparatus for controlling the injection, into a well tubing string, of fluid such as gas for gas lift operations or liquids containing treatment chemicals; and more particularly to side pocket mandrels and flow control devices in the side pocket receptacles of such mandrels.

Side pocket mandrels have been used for many years for different applications involving the flow of fluids from the exterior of a tubing string into the interior thereof. Such applications include the practice of gas lift techniques for recovery of oil from oil wells, and the injection of liquids which may include treatment chemicals for different treatment purposes within the well. Davis et al U.S. Pat. No. 4,066,128, issued Jan. 3, 1978, is concerned with a side pocket mandrel including a flow control device in the side pocket receptacle thereof for controlling the injection of gas into the tubing string for a gas lift operation. The flow control device of this Davis patent includes a sliding sleeve valve which controls the port opening into the side pocket receptacle from the exterior of the mandrel, and which is shiftable between a port-closing and a port-opening position. This sliding sleeve valve is operated automatically by a flow control valve which is inserted selectively into the side pocket receptacle of the mandrel. When the control valve is placed therein, the sleeve valve is moved automatically to the port-opening position; and when the control valve is removed from the receptacle, the sliding sleeve valve is moved automatically to the port-closing position.

A disadvantage of the flow control device of the Davis patent is that the sliding sleeve valve is not removable from the side pocket receptacle. Accordingly, with this design, should the sliding sleeve valve become defective and require servicing or replacement, it will be necessary to shut down the well and withdraw from the well the side pocket mandrel carrying that sliding sleeve valve and of course all of the associated production tubing string. This is obviously a time consuming and expensive procedure, and a much preferred form of flow control device would include a sliding sleeve valve which could be removed from the side pocket receptacle either for servicing or replacement.

OBJECTS AND SUMMARY OF THE INVENTION

An object of this invention is to provide an improved flow control device in a side pocket mandrel, for controlling the flow of gas or liquid injected into the well from the annulus between the well casing and tubing string.

Another object of this invention is to provide such improved flow control device including a sliding sleeve valve in the side pocket receptacle of the mandrel, which sliding sleeve valve is operated automatically between closed and open positions by an associated control valve placed into and removed from the side pocket receptacle.

A further object of this invention is to provide such an improved flow control device wherein the sliding sleeve valve may be removed from the receptacle of the side pocket mandrel and may be replaced therein, by suitable pulling and running tools.

Still another object of this invention is to provide such improved flow control device wherein the sliding sleeve valve and associated flow control valve have coacting latch members to engage and lock the two valves together, when the flow control valve is placed in the side pocket receptacle and moves the sleeve valve from its closed position to its open position, and which will effect the return of the sleeve valve to its closed position when the flow control valve is removed from the side pocket receptacle.

A still further object of this invention is to provide such improved flow control device in which the sleeve valve is positively latched in closed position against movement in either longitudinal direction, but is readily unlatched for displacement to its open position by a longitudinal force applied thereto during placement of a proper flow control valve.

A well device for accomplishing these objects includes the following components. A side pocket mandrel includes an elongated receptacle parallel to the main passage, and an external side port opening to that receptacle. A flow control assembly, for disposition in that receptacle, includes a removable sliding sleeve valve. The sleeve valve is movable between an upper closed position and a lower open position relative to the side port; and the sleeve valve has releasable latching lug means for latching engagement with a latching recess of said receptacle in the closed position. A biasing means associated with the latching lug means, urges the lug means outwardly for the latching engagement. The receptacle includes a portion immediately below the latching recess, which is enlarged relative to the portion immediately above that latching recess, so that an insert positioned within the sleeve valve may limit the inward movement of the latching lug means to permit release of the lug means from the latching recess for downward movement of the sleeve valve to the open position, but to prevent release of the latching lug means from the recess for upward movement of the sleeve valve.

The flow control assembly further includes a removable flow control valve. The flow control valve includes an upper latching body and a lower elongated nose configured to be received within the sleeve valve and to limit the inward movement of the latching lug means. The latching body includes releasable latch means for coaction with another latching recess of the receptacle, and includes an upper fishing neck for coaction with running and pulling tools.

The sleeve valve has an internal latching shoulder to be engaged by a suitable pulling tool to withdraw the sleeve valve from the receptacle of the side pocket mandrel.

The novel features and the advantages of the invention, as well as additional objects thereof, will be understood more fully from the following description when read in connection with the accompanying drawings.

DRAWINGS

FIGS. 1A, 1B and 1C, taken together, constitute a longitudinal sectional view of a side pocket mandrel and the sliding sleeve valve of a flow control device according to the invention;

FIGS. 2 and 3 are transverse sectional views taken along the lines 2—2 and 3—3, respectively, of FIG. 1;

FIGS. 4A and 4B, taken together, constitute a fragmentary longitudinal sectional view of a side pocket mandrel and flow control device according to the invention;

DESCRIPTION OF THE PREFERRED EMBODIMENTS

Figure 1A:
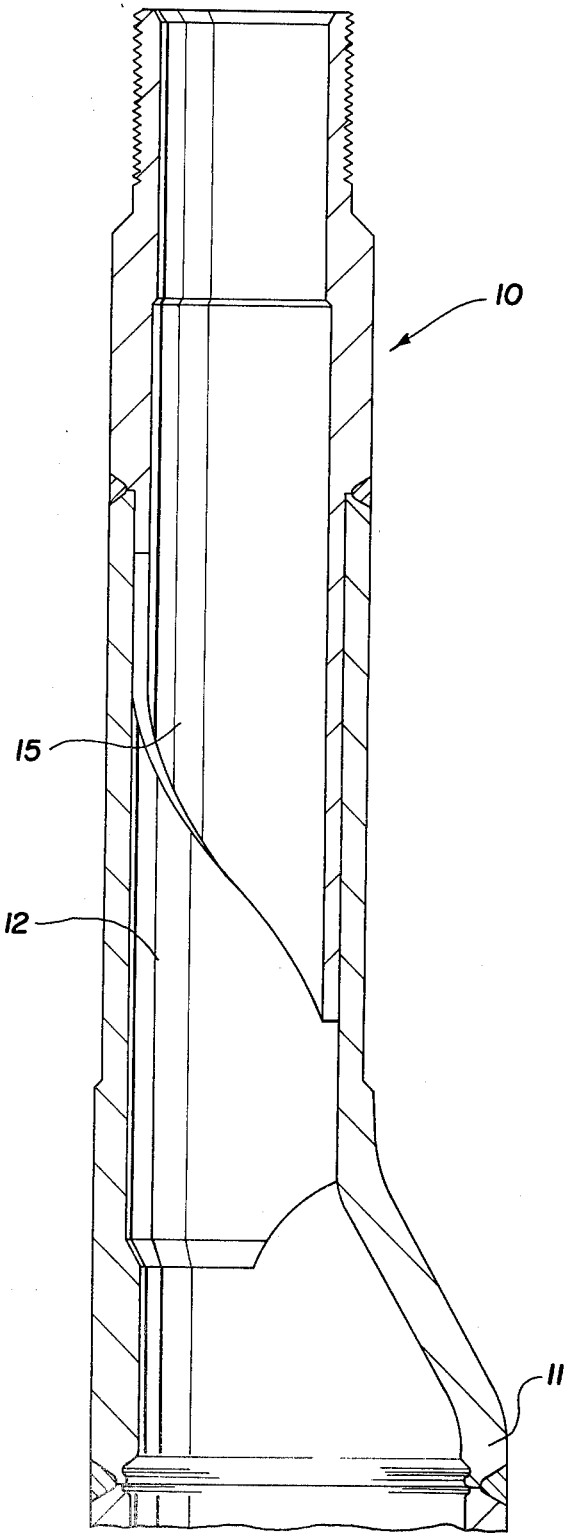
Figure 1B:
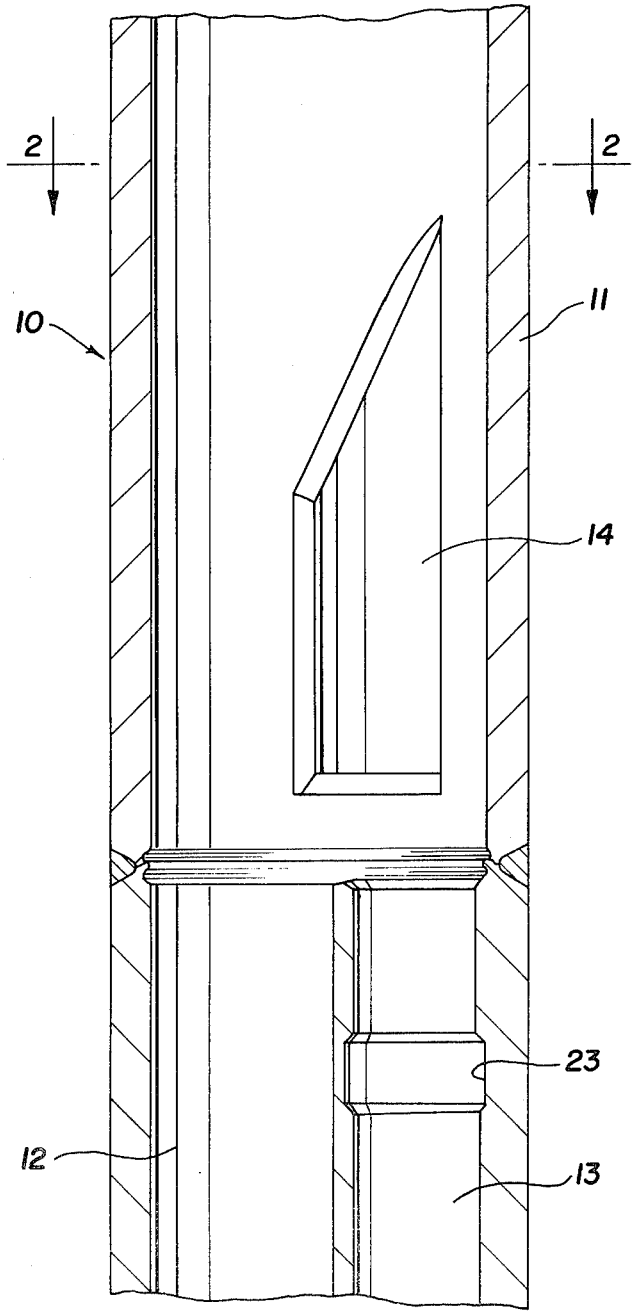
Figure 1C:
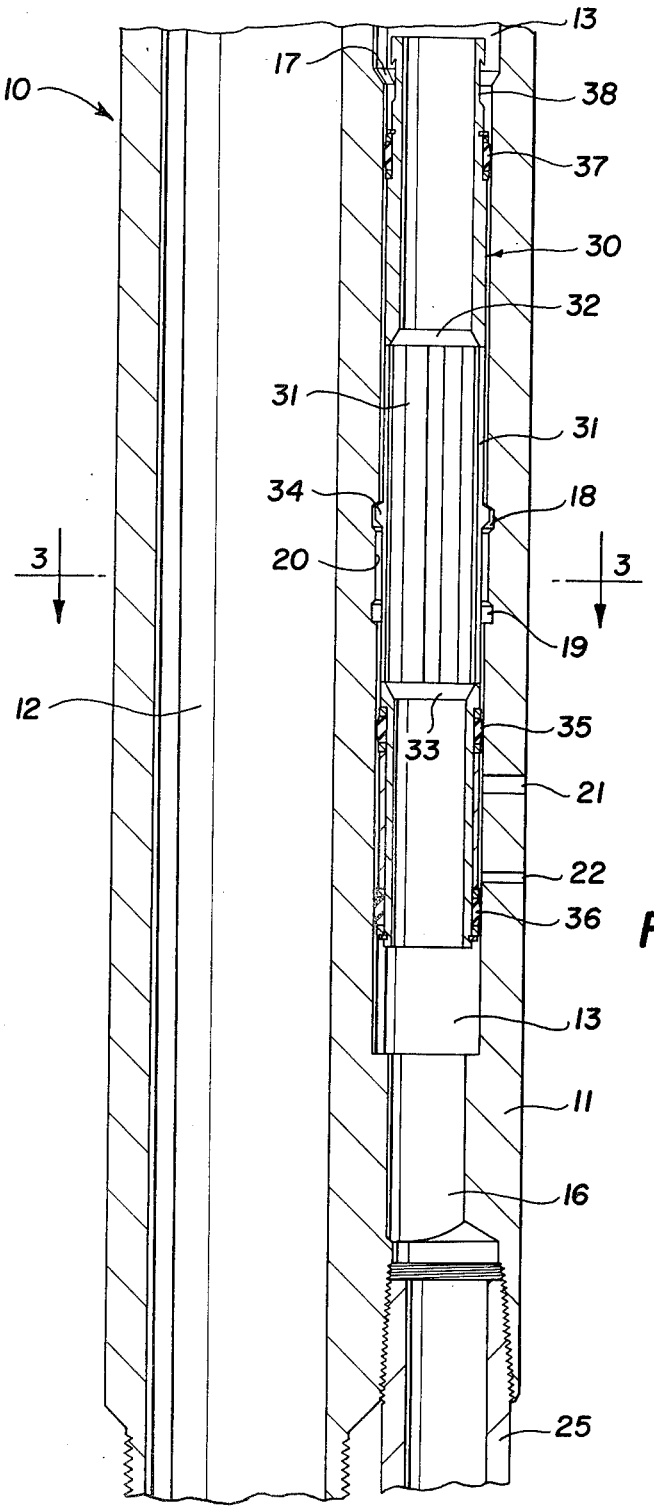
Figure 2:
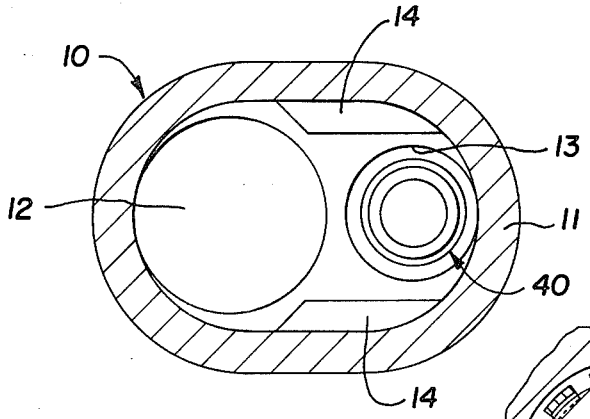

The drawings illustrate a side pocket mandrel 10 for connection into a well flow conductor in the form of a tubing string consisting of sections or joints of tubing; the side pocket mandrel being connected between adjacent joints and forming part of the string. The side pocket mandrel is an elongated generally tubular member having a projecting belly portion 11 at one side which forms the side pocket. The side pocket mandrel has a main bore 12 axially aligned with threaded pins at the opposite ends of the mandrel, so that the main bore will be axially aligned with the bore of the tubing string. A smaller generally parallel bore 13 is formed in the side pocket and defines a receptacle for the flow control assembly to be described.

The side pocket is opened to the main bore 12 for a substantial length above the receptacle 13 to enable the lateral placing of a tool in generally axial alignment with the receptacle to be then moved downwardly into the receptacle; and guide cams 14 are provided to assist in guiding a tool from the upper pocket portion into the receptacle. At the upper end of the mandrel 10, an orienting cam 15 is provided in association with the main bore 12. This orienting cam is provided to rotationally orient a tool which is lowered through the main bore and carries a tool to be placed in the side pocket receptacle, the tool being then oriented to enable the lateral placement of the tool into the side pocket.

A side inlet port 21 communicates the receptacle with the exterior of the side pocket 11. In the illustrated form of side pocket mandrel, a discharge passage 16 is formed at the lower end of the pocket in generally axial alignment with the receptacle 13; and this discharge passage terminates in a threaded box to enable connection of a side tube or string 25 for conducting fluid, such as chemical treatment fluid, to a lower point in the well. In another type of side pocket mandrel, a discharge passage might communicate the lower end of the receptacle with the main bore to provide for the injection of fluid from the receptacle into the main bore. In either case, the flow of fluid from the receptacle is under the control of a flow control assembly to be now described.

The lower portion of the receptacle 13 is configured for coaction with a sliding sleeve valve 30; and the wall of this lower portion is cylindrical and of generally uniform section to provide seal surfaces for coacting annular seals of the sliding sleeve valve. This lower receptacle portion terminates, at its upper end, in an outwardly beveled shoulder 17. Intermediate the ends of this lower receptacle portion there are provided latching and relief recesses 18 and 19, respectively; and the receptacle wall portion 20 between these recesses has a slightly larger diameter than the wall immediately above the upper latching recess 18, the purpose of which will be described subsequently.

The upper portion of the receptacle 13, above the shoulder 17, is at least slightly larger in diameter than that of the lower portion; and this upper portion particularly includes an annular latching recess 23 for latching a flow control valve as will be described.

The sleeve valve 30 consists of an elongated tubular body provided with a plurality of elongated circumferentially spaced collet fingers 31 intermediate its ends. The inner diameter of the sleeve valve is uniform at both ends, and at the central portion the inner diameter is greater to define a central thin wall section bounded by upper and lower shoulders 32 and 33. The collet fingers 31 are formed by circumferentially spaced slots formed in this thin wall section; and these slots, in addition to forming the collet fingers, also form fluid ports through the wall of the sleeve valve. Integral outwardly extending lugs 34 are formed intermediate the ends of respective collet fingers 31, for latching engagement with the latching recess 18.

Two external annular seal members 35 and 36 are provided at the lower end portion of the sleeve valve, below the collet fingers 31; and these seal members are axially spaced for coaction with the inlet port 21 as will be described. An upper annular seal member 37 is provided adjacent to the upper end of the sleeve valve for sealing engagement with the seal surface above the latching recess 18.

An external annular latching groove 38 is provided adjacent to the upper end of the sleeve valve for coaction with the control valve as will be described.

The control valve 40 is an elongated assembly consisting of four stacked components, namely: an upper latch body 41, a latch collet 42, a latch adaptor 43, and an elongated nose 44. The latch body 41 houses the mechanism for latching and unlatching the control valve from the side pocket receptacle 13; the latch collet and latch adaptor provide the mechanism for latching the control valve to the sliding sleeve valve 30; and the nose 44, which is received within the sliding sleeve valve, includes a valve mechanism for controlling fluid flow.

The latch mechanism for the control valve 40 is a rotating cam 45 mounted for rotation about an axis perpendicular to the longitudinal axis of the control valve assembly, and which is spring biased for rotation in a clockwise direction (as viewed in the drawings) for coaction with the latching recess 23. A fishing neck 46, mounted at the upper end of the latch body, extends within the latch body and provides a shoulder 47 at its lower end for coaction with a mating shoulder of the rotating cam, to limit rotation of that cam to the position wherein its integral latching lug projects laterally into the latching recess. The biasing spring permits counterclockwise rotation of the cam to permit entry of the control valve assembly into the receptacle. The fishing neck 46 is pinned to the latching body 41 by means of a shear pin 48 to maintain the shoulder 47 in the described interference position. The latching adaptor provides a lower reduced diameter portion, which coincides with the outer diameter of the nose 44, and a larger diameter upper portion thereby defining a downward facing annular shoulder 51 for engagement with the upper end of the sleeve valve 30. The latch collet 42 provides downward extending, circumferentially spaced collet fingers 50 which extend below the shoulder 51 of the latch adaptor; and the collet fingers have inwardly directed integral lugs at their distal ends for coaction with the sleeve valve latching groove 38 as will be described.

The nose 44 is a hollow member providing a chamber for the control valve mechanism, a lateral inlet port 52 intermediate its ends opening to the chamber, and a discharge port 53 from the chamber at the lower end of the nose. External annular seals 54 are provided adjacent to the upper and lower ends of the nose 44 for sealing engagement with the internal seal surfaces of the sleeve valve above and below the collet fingers 31. An annular valve seat member 25 is provided within the nose chamber between the inlet and outlet ports. A valve closure member 56, for coaction with the valve seat 55, is mounted in a collet sleeve 57 which is in turn mounted for limited upward movement within the nose 44. A bellows 58 is secured in sealing relation between the lower end of the collet sleeve 57 and the nose housing to define a sealed chamber 59 above the collet sleeve to be charged with a charge of gas at a selected pressure. By this means a selected biasing force is provided to maintain the valve closure member 56 seated on the valve seat 55. The bellows sleeve 57 provides a downward facing piston area exposed to the fluid entering the inlet port 52, to effect the lifting of the valve closure member when the pressure of this entering fluid is sufficient.

OPERATION

The several stages of operation of the described well flow control device will now be described. FIGS. 1A, 1B, 1C, 2 and 3 illustrate the device with the sliding sleeve valve disposed in the closed position, wherein the annular seals 35 and 36 are disposed on opposite sides of the inlet port 21 of the side pocket mandrel. The sliding sleeve valve, then, excludes the fluid surrounding the side pocket mandrel from entering the interior of the mandrel. The sleeve valve is maintained in this closed position by the latching of the collet lugs 34 within the latching recess 18. The sleeve valve will have been placed in this position within the side pocket receptacle 13 prior to running the side pocket mandrel into the well with the tubing string. Alternatively, the sleeve valve 30 may have been placed within the receptacle by a suitable running tool. It will be seen that, in this closed position of the sleeve valve, the upper end of the valve, including the latching groove 38, extends above the receptacle shoulder 17.

Figure 5:
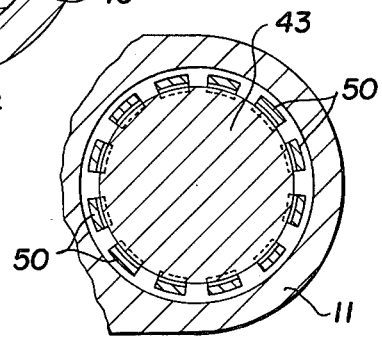
FIG. 5 is a transverse sectional view taken along the line 5—5 of FIG. 4A.
Figure 3:
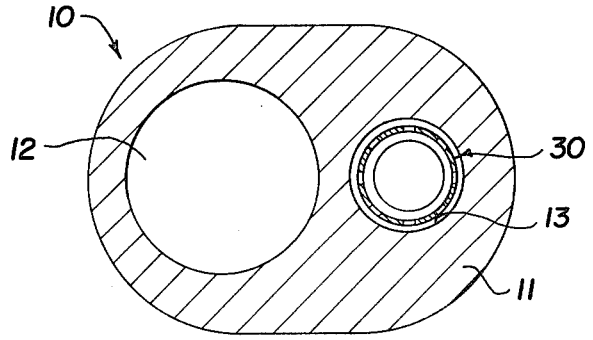
Figure 4A:
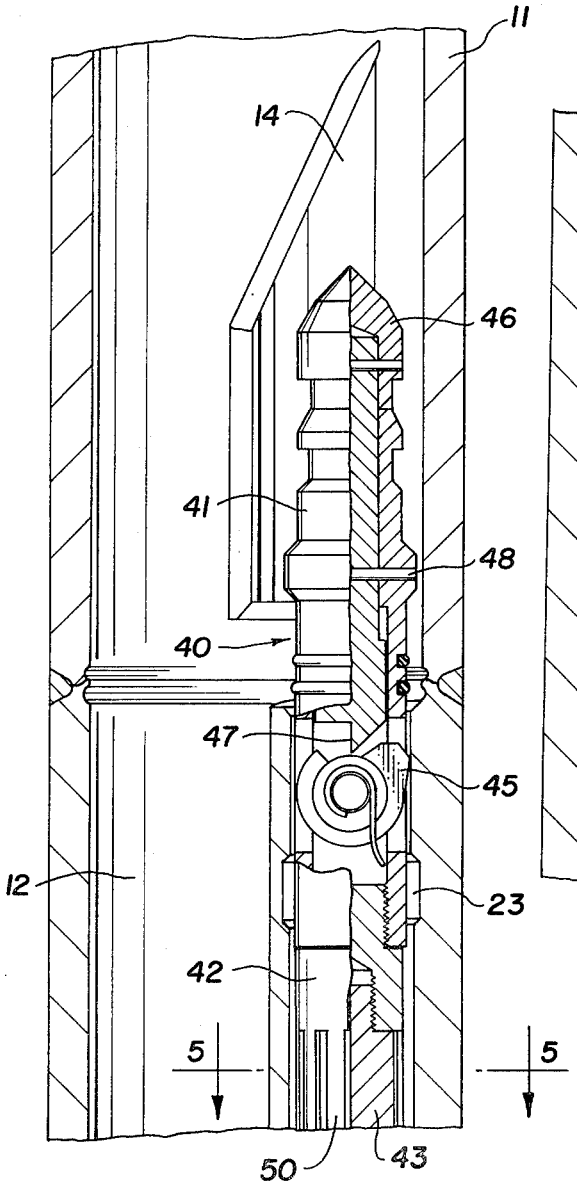
Figure 4B:
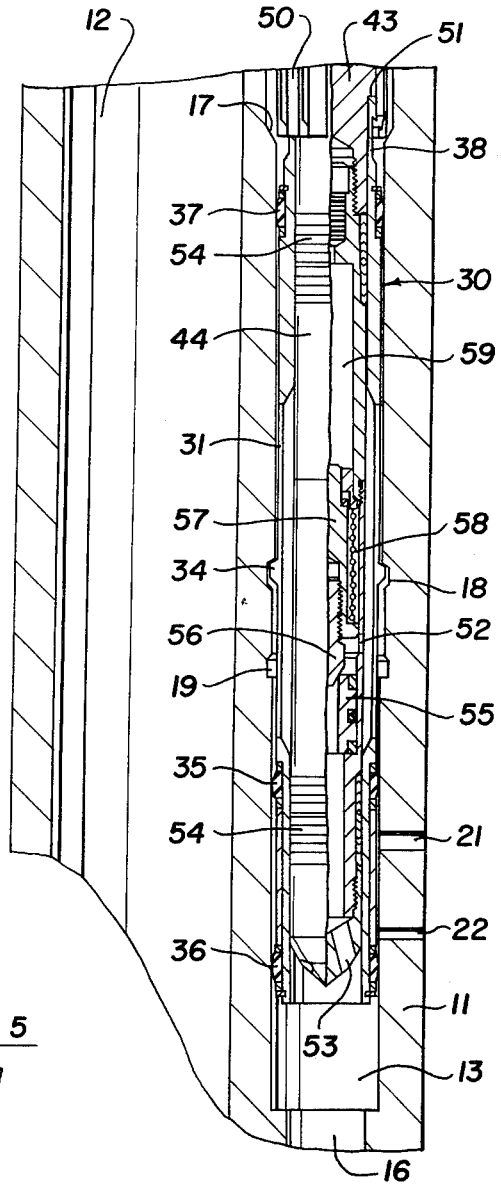

The control valve 40 is run into the well by means of a suitable tool which is engaged with the upper end of the latch body 41, and which coacts with the orienting cam 15 to place the control valve into the side pocket of the mandrel 10 and to lower the control valve into the receptacle 13. FIGS. 4A, 4B and 5 illustrate the control device where the control valve 40 has been lowered to the point where it just engages the upper end of the sleeve valve 30. It will be noted that in a normal condition of the collet fingers 50, the inner diameters of the latching lugs of the collet fingers is greater than the outer diameter of the upper end of the sleeve valve, so that the collet fingers pass over the sleeve valve for lateral alignment with the latching groove 38. The latch adaptor shoulder 51 is seated against the upper end of the sleeve valve so that further downward movement of the control valve will effect coincident downward movement of the sleeve valve. The rotating cam 45 has been rotated back by the receptacle wall, and in position to move into the latching recess 23.

Figure 6:
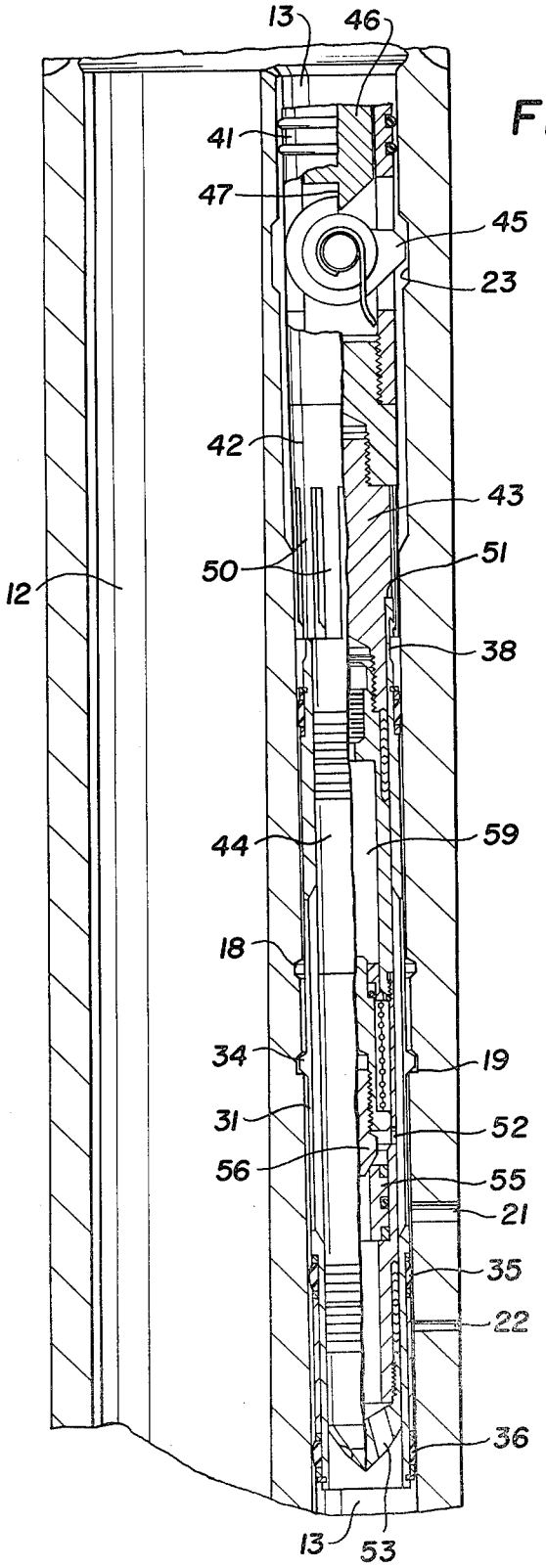
FIG. 6 is a fragmentary longitudinal sectional view of a side pocket mandrel and flow control device according to the invention, showing the flow control device, in a different operative condition.

With further downward movement of the control valve, the assembly has been moved downward to the open position of the sliding sleeve valve which is illustrated in FIG. 6. With this further downward movement, the distal ends of the collet fingers 50 have been cammed inward by the shoulder 17 to engage the collet finger lugs in the latching groove 38 of the sleeve valve; and the two valves are then locked together axially. With the downward force applied by the control valve, the lugs 34 of the sleeve valve collet fingers are cammed inwardly and pass along the wall 20 to move into latching engagement with the lower relief recess 19. This lower relief recess is provided to allow the collet fingers 31 to relax. In this position the rotating cam 45 of the latch body 41 has moved into alignment with the latching recess 23 and snaps into latching engagement to prevent upward movement of the assembled valves until that rotating cam is released. In this open position of the sleeve valve, the annular seal 35 has moved below the side pocket inlet port 21 so that this inlet port is now communicated with the sleeve valve port defined by the slots between the collet fingers 31, and with the inlet port 52 of the control valve. The valve closure member 56 and its associated collet sleeve 57 are now exposed to the pressure of fluid in the well annulus. When that annulus pressure is sufficient, the closure member 56 will open to allow the flow of fluid to the discharge port 53 through the side pocket discharge passage 16 to the side string 25 of this illustrated embodiment.

It will be noted that a relief port 22 in the pocket wall, below the inlet port 21, now communicates the space between the seals 35 and 36 with the exterior of the pocket to relieve trapped pressure.

When it is desired to close the inlet port 21 of this particular side pocket, a suitable pulling tool is run into the well and displaced into the side pocket to engage the fishing neck 46 of the control valve. With subsequent upward movement of the fishing neck 46, the shear release pin 48 will be sheared since the rotating cam will not allow upward movement of the latch body 41. With the shearing of the release pin 48, the shoulder 47 of the fishing neck is lifted out of its interference relation with the shoulder of the cam 45, allowing the cam to be rotated further by the spring to release it from the latching recess 23.

Further upward pulling on the fishing neck will raise the control valve 40; and since the lugs of the collet fingers 50 are engaged in the latching groove 38, the sliding sleeve valve 30 will be moved upwardly until the latching lugs 34 engage the latching recess 18. The movement of the lugs 34 is permitted by the fact that the larger diameter of the wall portion 20 permits the passage of the lugs through the allowed deflection of the collet fingers 31 permitted by the control valve nose 44. However, because the receptacle bore 13 above the latching recess 18 is smaller, the allowable inward deflection of the lugs 34 will not allow upward movement beyond the latching recess 18.

Figure 7:
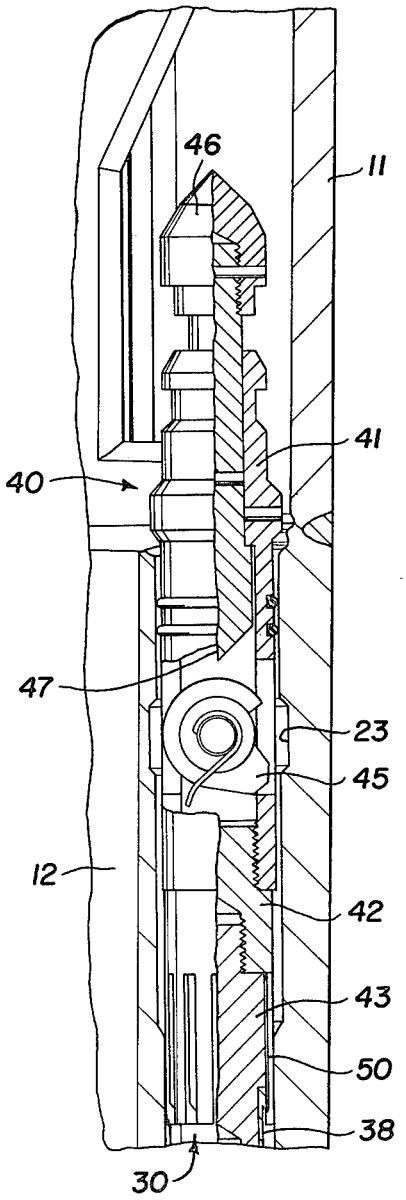
FIG. 7 is a fragmentary longitudinal sectional view of the side pocket mandrel and flow control device, showing the flow control device in still another operative condition.

In this position, illustrated in FIG. 7, the upper end of the sleeve valve 30 has now moved beyond the shoulder 17 allowing expansion of the collet fingers 50 to release the control valve from the sleeve valve. Hence further upward movement of the control valve, will separate the control valve from the sleeve valve and allow withdrawal of the control valve from the well. The sleeve valve then remains in the closed condition illustrated in FIG. 1C.

PULLING TOOL—FIGS. 8 AND 9

Figure 8:
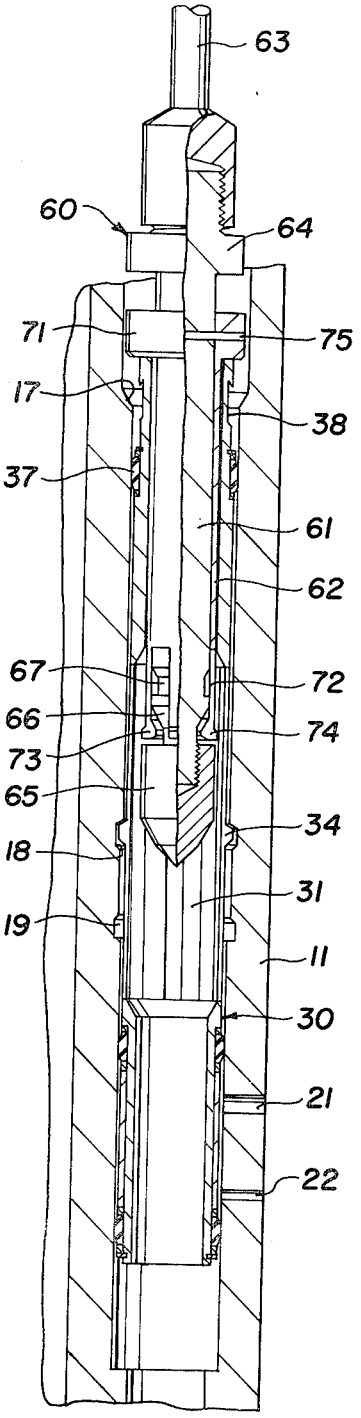
FIG. 8 is a fragmentary longitudinal sectional view of a pulling tool for a sliding sleeve valve, shown in one operative position in a side pocket mandrel.
Figure 9:
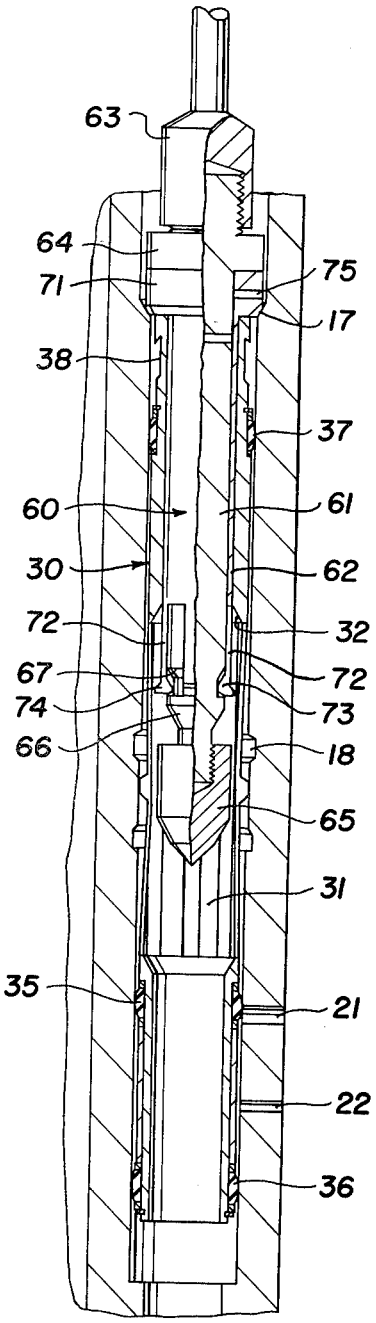
FIG. 9 is a fragmentary longitudinal sectional view of the assembly of FIG. 8, shown in another operative condition.

FIGS. 8 and 9 illustrate the structure and operation of a pulling tool 60 suitable for withdrawing the sleeve valve 30 from the mandrel receptacle 13, should that become necessary because of malfunction of the valve or of a need for servicing or replacement. The pulling tool is an elongated assembly consisting of a body 61 and a sleeve 62. The body is threaded at its upper end for attachment to a suitable running tool 63, shown fragmentarily in the drawing.

The body is provided with an external radial flange 64 adjacent to its upper end; and its lower end is threaded to receive a nose piece 65 which serves to prevent loss of the sleeve 62. Adjacent to its lower end, the body is provided with a conoid cam surface 66, and immediately upward from the conoid cam surface is an annular latching groove 67.

The sleeve 62 is mounted for close sliding relation with the body 61, and is provided with an external radial flange at its upper end. The lower end of the sleeve terminates in axially extending circumferentially spaced collet fingers 72; and the distal ends of these fingers are enlarged to provide radially inward extending lugs 73 and radially outward extending lugs 74. In the assembled form for running into the receptacle 13, the sleeve 62 is pinned to the body 61 by means of a shear pin 75. In this pinned position, the inward directed lugs 73 are disposed just below the conoid cam surface 66.

FIG. 8 illustrates the condition of this pulling tool when it has been run into the receptacle 13 to the point where the sleeve flange 71 has just engaged the upper end of the sliding sleeve valve 30. It will be seen that the pulling tool assembly is sufficiently long that, in this condition, the outward extending lugs 74 are disposed below the upper internal shoulder 32 of the sleeve valve. It will be seen that the outer diameter of the sleeve lugs 74, in this condition, is just small enough to pass through the smaller diameter bore of the sleeve valve 30.

With further downward movement of the pulling tool 60, the sleeve flange 71 engages the shoulder 17 of the receptacle 13, which prevents further downward movement of the sleeve. With further downward movement of the body 61 then, the shear pin 75 is sheared and the body is moved downward to engage its flange 64 with the sleeve flange. In this condition the conoid cam 66 of the body has cammed the collet fingers outward; and the inward lugs 73 of the collet fingers then lock in the body latching groove 67. In this locked condition, the outward lugs 74 are positioned in interference relation with the sleeve valve shoulder 32, so that the pulling tool 60 cannot now be separated from the sleeve valve 30.

With subsequent lifting of the pulling tool body 61, the sleeve is also lifted through the latching of the lugs 73 in the groove 67; and when the outward lugs 74 engage the sleeve valve shoulder 32, the sleeve valve will be lifted out of the receptacle along with the pulling tool. The pulling tool is dimensioned, relative to the sleeve valve collet fingers 31, that the lugs 34 may deflect inward sufficiently to disengage from the latching recess 18 to allow withdrawal of the sleeve valve.

What has been described is a unique well device for the purpose of controlling the flow of injection fluid from the annulus surrounding the production tubing string into that tubing string at one or more points within the well. A principal feature of the invention is the latching mechanism for the sleeve valve which incorporates coaction of the sleeve valve design, the configuration of the receptacle, and the coaction of a portion of the control valve which is selectively joined with the sleeve valve to effect and control the flow of the injection fluid. This coacting latching mechanism effects positive latching of the sleeve valve in the closed position, allows ready shifting of the sleeve valve by the control valve to the open position, and upon removal of the control valve effects positive shifting of the sleeve valve to the closed position and release from the sleeve valve to prevent withdrawal at that point from the receptacle.

Another feature of the invention is that the design of the sleeve valve permits it to be withdrawn readily from the receptacle when replacement or servicing is required. Similarly, the replacement or reconditioned sleeve valve may be readily replaced within the receptacle of the side pocket mandrel.

While the preferred embodiment of the invention has been illustrated and described, it will be understood by those skilled in the art that changes and modifications may be resorted to without departing from the spirit and scope of the invention.

What is claimed is:

1. A well device for controlling flow between the exterior and interior of a well flow conductor comprising:

a side pocket mandrel having an elongated receptacle and an external side port opening to said receptacle; said receptacle having axially spaced latching recesses;

a flow control assembly, for disposition in said receptacle, including a removable sliding sleeve valve and a coacting removable flow control valve;

said sleeve valve being disposed for movement between an upper closed position and a lower open position relative to said side port; said sleeve valve having releasable latching lug means for latching engagement with a latching recess of said receptacle in said closed position, and biasing means urging said latching lug means outwardly for said latching engagement;

said flow control valve comprising an elongated assembly including an upper latching body and a lower elongated nose configured to be received within said sleeve valve; said latching body including releasable latch means for coacting engagement with a latching recess of said receptacle, and an upper fishing neck for coaction with running and pulling tools;

said nose and said receptacle being configured for coaction with said latching lug means to limit inward movement of said latching lug means to permit downward movement of said sleeve valve to said lower open position and to prevent release of said sleeve for upward movement from said upper closed position.

2. A well device as set forth in claim 1 said receptacle being configured, relative to said latching lug means of said sleeve valve, to permit movement of said assembled sleeve valve and control valve between said closed and open positions of said sleeve valve, and to prevent movement of said sleeve valve above said closed position.

3. A well device as set forth in claim 2 said receptacle including a portion immediately below said sleeve valve latching recess enlarged relative to a portion immediately above said recess, whereby limited inward deflection of said latching lugs permitted by said control valve nose permits downward movement of said sleeve valve lugs from said latching recess but prevents upward movement of said sleeve valve lugs from said latching recess.

4. A well device as set forth in claim 3 said sleeve valve having a plurality of axially extending circumferentially spaced collet fingers, having external lugs thereon for engagement in said latching recess; said collet fingers and associated lugs defining said latching lug means and associated biasing means;

said control valve nose being configured to prevent inward deflection of said collet fingers sufficient to release said lugs from said latching recess for upward movement therefrom.

5. A well device as set forth in claim 2 said control valve and said sleeve valve having coacting latching means for latching said valves together axially; said latching means being effective when said valves are moved downwardly from said upper closed position of said sleeve valve; and said latching means being self-releasing when said sleeve valve is moved by said control valve upward to said closed position of said sleeve valve.

6. A well device as set forth in claim 5 said coacting latching means comprising axially extending collet fingers with inwardly projecting distal lugs associated with one valve, for coaction with an annular latching groove associated with the other valve; and said receptacle being configured to urge said collet finger lugs inwardly into latching engagement in said latching groove, when said control valve moves said sleeve valve downwardly from its closed position.

7. A well device as set forth in claim 2 said latch means for said control valve being latched in the associated latching recess of said receptacle when said sleeve valve is in its open position.

8. A well device as set forth in claim 4 said sleeve valve having a plurality of circumferentially spaced slots intermediate its ends, defining fluid ports traversing the wall of said sleeve valve; external annular seal means provided on said sleeve valve at opposite ends of said slots, for sealing relation with coacting sealing surfaces of said receptacle;

said collet fingers being formed by the intervening wall portions between said slots;

and said sleeve valve having internal seal surface means at the opposite ends of said slots, for coaction with external seal means of said control valve nose.

9. A well device as set forth in claim 8 said control valve nose housing a control valve mechanism; and said control valve nose having a side inlet port to said valve mechanism, for communication with said sleeve valve slots, and an outlet port for said valve mechanism opening to the lower end of said nose.

10. A well device for controlling flow between the exterior and interior of a well flow conductor comprising:

a side pocket mandrel having an elongated receptacle and an external side port opening to said receptacle; said receptacle having a latching recess;

a removable sliding sleeve valve disposed in said receptacle;

said sleeve valve being disposed for movement between an upper closed position and a lower open position relative to said side port; said sleeve valve having releasable latching lug means for latching engagement with said latching recess in said closed position, and biasing means urging said latching lug means outwardly into said latching engagement;

said receptacle including a portion immediately below said latching recess enlarged relative to a portion immediately above said latching recess, whereby inward movement of said latching lug means limited by an insert when disposed within said sleeve valve permits downward movement of said sleeve valve lug means from said latching recess but prevents upward movement of said sleeve valve lug means from said latching recess.

11. A well device as set forth in claim 10 said sleeve valve having latching means for latching to a coacting control valve having said insert to be disposed within said sleeve valve; said latching means being effective when said valves are moved downwardly from said upper closed position of said sleeve valve; and said latching means being self-releasing when said sleeve valve is moved by said control valve upward to said closed position of said sleeve valve.

12. A well device as set forth in claim 10 said sleeve valve having a plurality of axially extending circumferentially spaced collet fingers, having external lugs thereon for engagement in said latching recess; said collet fingers and associated lugs defining said latching lug means and associated biasing means;

said collet fingers being configured to engage an insert disposed within said sleeve to limit inward movement of said associated lugs.

13. A well device as set forth in claim 12 said sleeve valve having a plurality of circumferentially spaced slots intermediate its ends, defining fluid ports traversing the wall of said sleeve valve; external annular seal means provided on said sleeve valve at opposite ends of said slots, for sealing relation with coacting sealing surfaces of said receptacle;

said collet fingers being formed by the intervening wall portions between said slots;

and said sleeve valve having internal seal surface means at the opposite ends of said slots, for coaction with external seal means of said control valve nose.

14. A well device as set forth in claim 10 said receptacle having a portion of reduced cross section for receiving said sleeve valve, terminating in an upper outwardly extending shoulder; the upper end of said sleeve valve, in said latched condition thereof, extending upwardly above said shoulder;

said sleeve valve having an internal downward facing shoulder;

a pulling tool for said sleeve valve comprising an elongated body having an upper, outward extending flange means, and a sleeve slidably mounted on said body having an upper, outward extending flange means; said sleeve flange means being configured for interference engagement with said receptacle shoulder; said sleeve being releasably pinned to said body with said flanges disposed in spaced relation to each other;

said pulling tool sleeve having latching lug means disposed adjacent to its lower end, to be urged outwardly into interference engagement with said sleeve valve internal shoulder; and said body having cam means for urging said latching lug means outwardly for said interference engagement, when said body flange means is moved toward said sleeve flange means.

15. A device as set forth in claim 14 said pulling tool body having an annular latching groove, and said pulling tool sleeve having coacting latching lug means to be latched in said groove when said body flange means is moved toward said sleeve flange means.

16. A flow control valve for use in a well device for controlling flow between the exterior and interior of a well flow conductor; said well device including a side pocket mandrel having an elongated receptacle and an external side port opening to said receptacle, and a sliding sleeve valve disposed for movement in said receptacle between an upper closed position and a lower open position relative to said side port;

said flow control valve comprising an elongated body, configured to be received within said receptacle, having latching means for latching engagement with said sleeve valve; said control valve latching means comprising axially extending collet fingers with inwardly projecting distal lugs, for coaction with latching means of said sleeve valve.

17. A flow control valve as set forth in claim 16 said collet fingers being configured to be urged radially inwardly by a receptacle surface into latching engagement with said sleeve valve latching means when said control valve engages said sleeve valve in said receptacle for downward movement thereof, and to be released from said latching means upon subsequent return movement of said sleeve valve to the engage position.

* * * * *